US007104164B2

(12) United States Patent
Jirele et al.

(10) Patent No.: US 7,104,164 B2
(45) Date of Patent: Sep. 12, 2006

(54) SPARK PLUG TOOL

(75) Inventors: James E. Jirele, Owatonna, MN (US); Dennis Hanson, Medford, MN (US)

(73) Assignee: SPX Corporation, Charlotte, NC (US)

( * ) Notice: Subject to any disclaimer, the term of this patent is extended or adjusted under 35 U.S.C. 154(b) by 145 days.

(21) Appl. No.: 10/882,321

(22) Filed: Jul. 2, 2004

(65) Prior Publication Data

US 2006/0000319 A1 Jan. 5, 2006

(51) Int. Cl.
*B25B 13/06* (2006.01)

(52) U.S. Cl. ..... 81/124.6; 7/100

(58) Field of Classification Search ..... 81/124.6, 81/125; 7/100

See application file for complete search history.

(56) References Cited

U.S. PATENT DOCUMENTS

| | | | | | |
|---|---|---|---|---|---|
| 3,869,945 | A | * | 3/1975 | Zerver | 81/125 |
| 3,924,492 | A | * | 12/1975 | Bray | 81/124.6 |
| 4,328,720 | A | * | 5/1982 | Shiel | 81/63 |
| 4,964,319 | A | | 10/1990 | Chang | 81/58.3 |
| D318,997 | S | * | 8/1991 | Baker | D8/29 |
| 5,074,172 | A | | 12/1991 | Fetter et al. | 81/125 |
| 5,074,173 | A | | 12/1991 | Cearley | 81/177.6 |
| 5,455,997 | A | * | 10/1995 | Nasiell | 29/456 |
| D364,543 | S | * | 11/1995 | Hennen | D8/14 |
| 5,572,913 | A | * | 11/1996 | Nasiell | 81/177.6 |
| 5,960,682 | A | | 10/1999 | Yamashita | 81/125 |
| 2002/0026859 | A1 | | 3/2002 | Suzuki | 81/121.1 |

OTHER PUBLICATIONS

2003 Snap-on Technologies, Inc., Jul. 21, 2003; Catalog 600; 105 & 355; 9/16 Spark Plug Socket; pn S9716KMAG.

Professional Tools and Equipment News, Apr. 2004; Reliable Auto Center, Fort Atkinson, WI; Mike Steptoe; "Lockit Socket".

* cited by examiner

*Primary Examiner*—David B. Thomas
(74) *Attorney, Agent, or Firm*—Baker & Hostetler LLP

(57) ABSTRACT

An apparatus and method for installing and removing a recessed spark plug to and from an engine without a component thereof becoming disengaged. The spark plug tool is long enough to reach a recessed spark plug and includes a first housing member having an opening fitted with an elastomeric sleeve for receiving a spark plug, a shaft that may be integrally connected to the first housing member, and a second housing member which may be integrally connected to the shaft. The second housing member can be coupled to a torque member.

29 Claims, 4 Drawing Sheets

SPARK PLUG TOOL

FIELD OF THE INVENTION

The present invention relates generally to a tool for installing or removing a component in an engine. More particularly, the present invention relates to a tool for installing or removing a sparkplug in or out of an internal combustible engine.

BACKGROUND OF THE INVENTION

Standard spark plug sockets having hex sizes, 5/8 inch and 13/16 inch, have been available for many years. These typical sockets are about 2½ inch long and some contain an internal elastomeric material sleeve that fits snugly over the ceramic portion of the spark plug to grip and protect the spark plug. On many modern engines, the spark plug is deeply recessed and difficult to reach unless an extension is used with the socket. In order to install or remove the recessed spark plug, a mechanic will select a properly sized socket that fits the spark plug, add an extension that mates with a wrench. The wrench provides the rotational force necessary to install or remove the spark plug. Occasionally, the frictional force between the elastomeric sleeve and the spark plug is greater than the force of the ball detent on the socket and its extension. If this occurs, the extension will become disengaged from the socket while the mechanic is trying detach the socket from the spark plug. As a result, the socket becomes difficult to reach and therefore, difficult to remove from the engine's recess. The mechanic then has to waste time and effort to reattach the extension with the socket, thereby, costing the consumer more for the repair. Additionally, exposed engine parts may be damaged when the extension becomes disengaged unexpectedly from the socket.

Accordingly, it is desirable to provide an easy-to-use and simple tool capable of readily installing and removing a deeply recessed spark plug without being susceptible to easy disengagement. In addition, it is desirable to provide a single tool capable of installing and uninstalling spark plugs and thereby, alleviate the need for a multiple tool assembly, which may otherwise be required to reached the deeply recessed spark plug. It is also desirable to provide a method of installing and uninstalling the deeply recessed spark plug that decreases the chance of a component being disengaged unexpectedly.

SUMMARY OF THE INVENTION

The foregoing needs are met, to a great extent, by the present invention, wherein in one aspect an apparatus is provided that in some embodiments includes a first housing member having an opening fitted with an elastomeric sleeve for receiving a spark plug. A shaft may be integrally connected to the first housing member and to a second housing member. The second housing member may be adapted to be coupled with a torque member.

In accordance with one aspect of the present invention, a spark plug tool is provided and can include a shaft that has a first end and a second end and a length from about 2–5 inches, a first housing member that may be integrally connected to the first end of the shaft and that may have a first open portion, wherein the first open portion can include an internal polygonal configuration that may be adapted to couple with about a 9/16 hex size spark plug, and a second housing member that may be integrally connected to the second end of the shaft and may have a second open portion for mating with a torque member. The spark plug tool can further include an elastomeric sleeve that may be disposed in the first housing member for retaining the spark plug, and wherein the first open portion can include an internal polygonal configuration that may have a cross sectional distance from about 0.566 inch to about 0.576 inch. The spark plug tool may have a length from about 3½ inches to about 12 inches. Additionally, the spark plug tool may have a length from about 5½ inches to about 10 inches. The first housing member can have a length from about 1 inch to about 4 inches or a length from about 2 inches to about 3 inches. Further, the shaft may have a length of about 3 inches. The second housing member may have a length from about ½ inch to about 3 inches and may have an knurled outer surface. The outer diameter of the shaft may be less than an outer diameter of the first housing member and may be less than an outer diameter of the second housing member. The torque member may include a wrench, pliers, a human hand, a screwdriver and other torquing tools.

In accordance another aspect of the present invention, a method of rotating a spark plug within an engine is provided and can include the steps of providing a spark plug tool having a first housing member adapted to mate with the sparkplug and a second housing member having a knurled outer surface and adapted to couple with a torque member, coupling the first housing member with the spark plug, and rotating the second housing member with the torque member, wherein the spark plug tool further includes a shaft having a length from about 2–5 inches that can be integrally connected to the first and second housing members and the first housing member may have a first open portion having an internal polygonal configuration that can be adapted to mate with about a 9/16 hex size spark plug. The step of coupling the first housing member with the spark plug can be with an elastomeric sleeve that can be disposed in the first housing member for retaining the spark plug. Rotating the second housing member can further include rotating in a first direction to install the spark plug or rotating in a second direction to remove the spark plug. The method can also include moving the spark plug tool with the spark plug away from the engine or moving the spark plug tool with the spark plug toward the engine.

In accordance with still another aspect of the present invention, a system for installing and removing a spark plug can include means for connecting having a first end and a second end and having a length from about 2–5 inches, means for coupling with a spark plug that may be integrally connected to the first end of the means for connecting and may have a first open portion for mating with a spark plug, wherein the first open portion can include an internal polygonal configuration that may be adapted to mate with about a 9/16 hex size spark plug, and means for engaging that may be integrally connected to the second end of the connecting means and may have a second open portion for mating with a torque means. The system may further include a gripping means disposed in the means for coupling for retaining the spark plug. The first open portion may include an internal polygonal configuration that may have a cross sectional distance from about 0.566 inch to about 0.576 inch. Further, the system for installing and removing may have a length from about 3½ inches to about 12 inches or from about 5½ inches to about 10 inches. The means for coupling may have a length from about 1 inch to about 4 inches or from about 2 inches to about 3 inches. Additionally, the means for connecting may have a length of about 3 inches. The means for engaging may have a length from about ½ inch to about 3 inches and may have a knurled outer surface. The outer diameter of the means for connecting may be less than an outer diameter of the means for coupling and may be less than an outer diameter of the means for engaging. The torque means may include a wrench, pliers, a human hand, a screwdriver and other torquing tools.

In accordance with still yet another aspect of the present invention, a spark plug tool can include a shaft that may have a first end and a second end and a length of about 3 inches, and a first housing member that may be integrally connected to the first end of the shaft and that may have a first open portion, wherein the first open portion can include an internal polygonal configuration that may be adapted to mate with about a 9/16 hex size spark plug, wherein the second end of the shaft is adapted to mate with a torque member.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
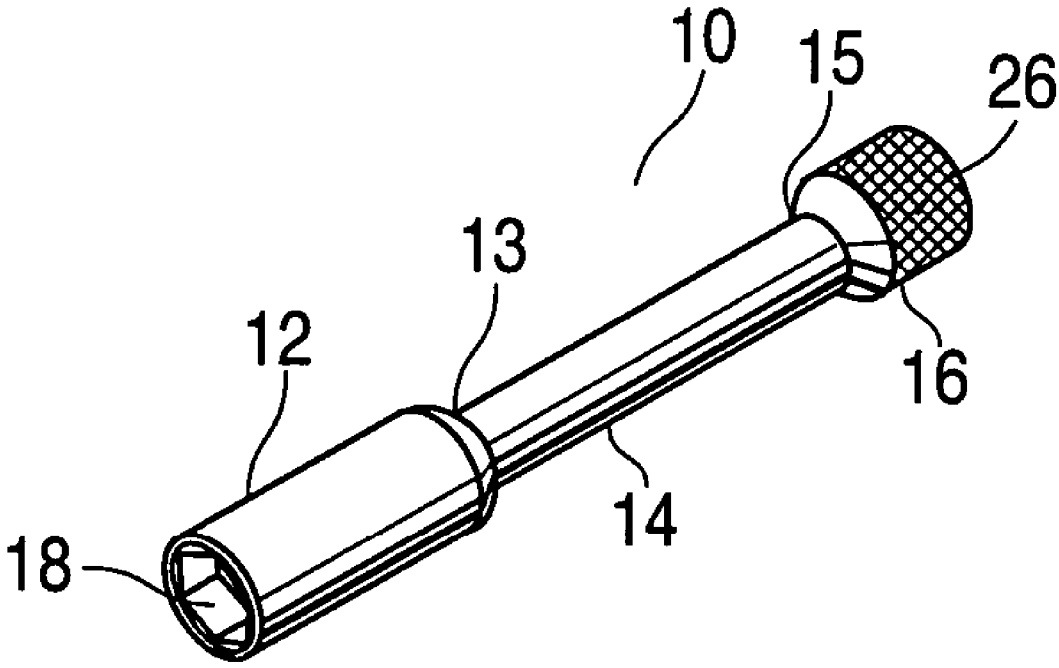
FIG. 1 is a perspective view of a spark plug tool according to a preferred embodiment of the invention.

An embodiment in accordance with the present invention provides a single tool capable of reaching a recessed spark plug that will replace the function of an assembly of tools without part of the assembly disengaging while in use. An embodiment in accordance with another aspect of the present invention provides a method of installing or removing the recessed spark plug by using a single tool. The invention will now be described with reference to the drawing figures, in which like reference numerals refer to like parts throughout.

FIG. 1 is a perspective view of a spark plug tool 10 according to an embodiment of the invention. The spark plug tool 10 may be composed of various components including a first housing member 12, a shaft 14, and a second housing member 16. The first housing member 12 is configured to include a first opening 18 for receiving a spark plug. The shaft 14 is configured to include a first 13 and second end 15. The first end 13 of shaft 14 may be designed to be connected to the first housing member 12. The second end 15 of shaft 14 may be designed to be connected to the second housing member 16. The shaft 14 may be designed to have a length that when combined with the first and second housing members is long enough to install or remove a deeply recessed spark plug.

The first end 13 of shaft 14 may be constructed and arranged to be integrally connected to the first housing member 12 and thereby, retaining the first housing member 12 with the spark plug tool 10 despite large axial forces 28 and rotational forces 32 (See FIG. 2) placed on the spark plug tool 10 during use. The second end 15 of shaft 14 may be constructed and arranged to be integrally connected to the second housing member 16. Preferably, the shaft 14, the first housing member 12, and the second housing member 16 are formed together to make a tool long enough to reach a recessed spark plug. Because the first and second housing members 12, 16 and shaft 14 may be constructed and arranged to be integrally connected, they will stay connected to each other despite large axial 28 and rotational forces 32 placed on the spark plug tool 10 during use. Additionally, the shaft along with the first and second housing members create a one-piece tool that can reach the recessed spark plug without an extension thereby, time is not wasted to find the extension in the tool box. While being formed together is the preferred manner in which to retain the first housing member 12 and the second housing 16 to the shaft 14, other means for retaining the first housing member 12 and the second housing member 16 to the shaft 14 may be utilized.

The design of the second housing member 16 may also include a knurled portion 26. The knurled portion 26 is generally configured to increase the coefficient of friction between the second housing member 16 and the mechanic's hand. Thus, enabling the mechanic to grip the tool well enough to install or remove the spark plug without using a torque member. The knurl portion 26 may envelope the entire outer surface of the second housing member 16 or be on a portion thereof depending on the needs of the user.

Figure 2:
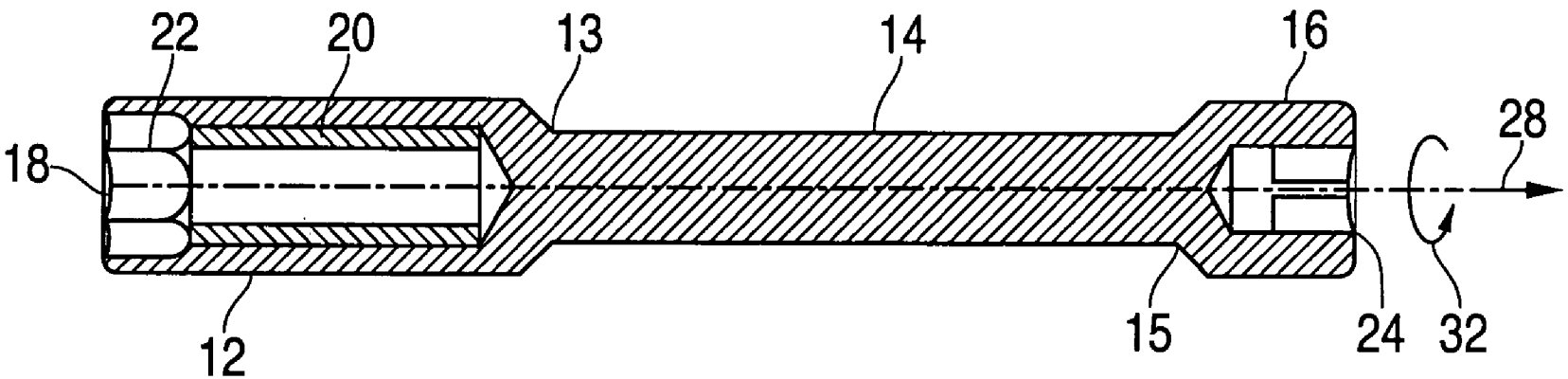
FIG. 2 is a schematic view illustrating a spark plug tool according to a preferred embodiment of the invention.

FIG. 2 is a schematic view illustrating the spark plug tool 10 according to a preferred embodiment of the invention. The spark plug tool 10 may be composed of various components including the first and second housing members 12, 16 and shaft 14. The first housing member 12 may have a length between about 1 inch and 4 inches, but preferably about 2 inches and a width between about ½ inch and 1½ inches, but preferably about ¾ inch. Also, the first housing member 12 is preferably configured to include the first opening 18 having a depth into the first housing member 12 between about 1 inch and 4 inches but preferably about 1¾ inches. The first opening 18 may be configured to accept a spark plug having a hex size between about ⅝ inch and 13/16 inch, but preferably about 9/16 inch. For example, the first opening 18 may be constructed and arranged to include an internal hex shape configuration 22 having a cross sectional distance of between about 0.566 inch and 0.576 inch. The shaft 14 may have a length between about 2 inches and 5 inches, but preferably about 3 inches and a width between about ¼ inch and 1 inch, but preferably about ½ inch. The shaft can be constructed to have the same outer diameter as the first and second housing members 12, 16 or can have a reduced outer diameter, as shown in FIG. 2. By having a shaft with a reduced outer diameter, the overall weight and cost of producing the tool can be reduced.

The second housing member 16 may have a length between about ½ inch and 3 inches, but preferably about 1 inch and a width between about ½ inch and 1½ inches, but preferably about ¾ inch. The total length of the tool in this particular embodiment is between about 3½ inches and 12 inches, but preferably about 5¾ inches. The second housing member 16 includes the second opening 24 for receiving a torque member.

Figure 3:
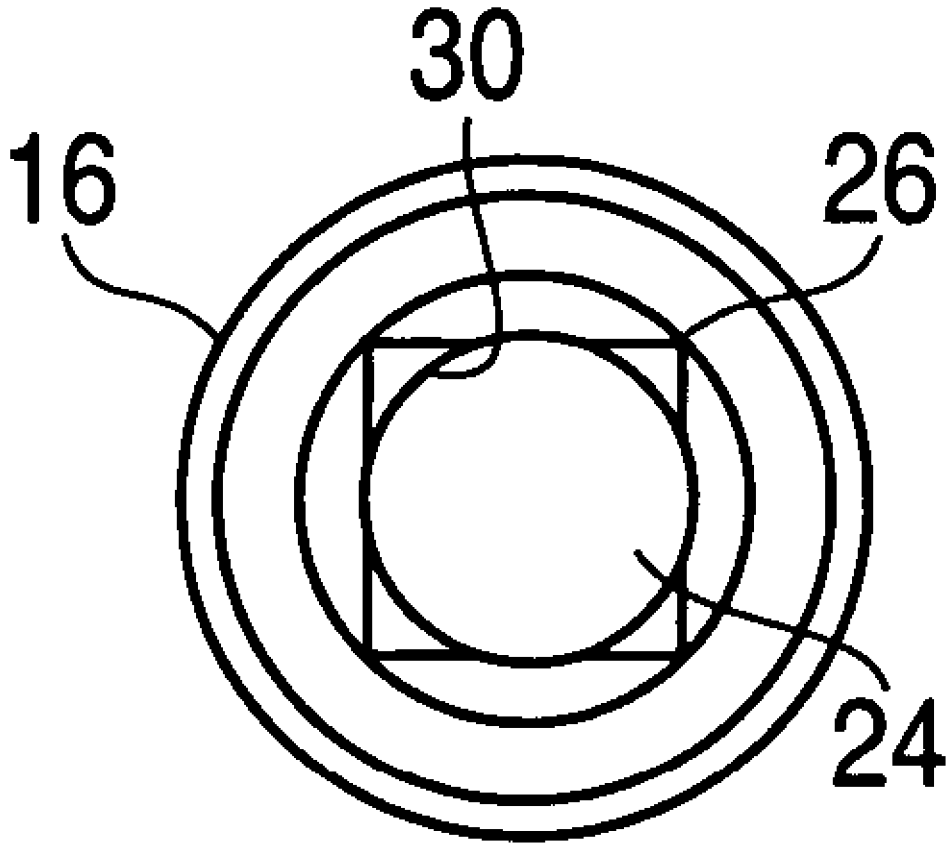
FIG. 3 is a cross-section view taken along the opening of the second housing member according to a preferred embodiment of the invention.

FIG. 3 is a cross-section view taken along the second opening 24 of the second housing member 16 according to a preferred embodiment of the invention. The second opening 24 may comprise a circle portion 30 disposed in a square portion 26 adapted to fit a torque wrench that is known in the art. Although the second opening 24 has the square 26 and circular 30 portions therein, the second opening 24 can have any configuration adapted to be used with a torque member. The torque member can include, among other things, a wrench, pliers, a human hand, a screwdriver and other tools that can provide rotational 32 and axial 28 forces on the spark plug tool 10.

In another embodiment of the invention, the first housing member 12 is further designed to include an elastomeric sleeve 20 disposed therein as shown in FIG. 2. The elastomeric sleeve 20 may be used to engage and protect a top portion of the spark plug. For purposes of this embodiment, FIG. 2 illustrates the elastomeric sleeve 20 disposed between the internal hex shape configuration 22 and the end of the first opening 18. The elastomeric sleeve has an inner diameter that is less than the outer diameter of the top portion of the spark plug. When the spark plug engages the elastomeric sleeve 20 disposed in the first housing member 12, it will preferably be retained by the elastomeric sleeve 20. The frictional force between the sleeve 20 and the spark plug helps to retain the spark plug when the axial force 28 and the rotational force 32 are asserted on the spark plug tool 10.

In operation, the spark plug tool 10 can be used to install or remove the spark plug to or from an engine. To install the spark plug, the spark plug with its upper portion can mate with the elastomeric sleeve 20 portion of the first housing member 12. The frictional force between the sleeve 20 and the upper portion of the spark plug will retain the sparkplug so that it can be placed in the engine. Once the spark plug is placed in the engine, a torque member can be attached to the second housing member 16, if not already, in order to provide axial 28 and/or rotational 32 forces to install the sparkplug. The torque member can be rotated in a first direction to install the spark plug. Alternatively, the mechanic's hand may be placed on the knurl portion 26 of the second housing member 16 to provide the same forces. Because the first and second housing members 12, 16 and the shaft 14 are all integrally connected, the spark plug tool 10 components will not disengage due to the forces acting on the sparkplug during use. Therefore, the first housing member 12 will not be retained in the engine due to disengagement from the shaft or unnecessary damage exposed portions of the engine.

To remove the sparkplug, the elastomeric sleeve 20 portion of the first housing member 12 can mate with the upper portion of the spark plug and retain it within the spark plug tool 10. The torque member can be attached to the second housing member 16 to provide the necessary axial 28 and/or rotation 32 force during use. The torque member can be rotated in a second direction in order to remove the spark plug from the engine.

Figure 4:
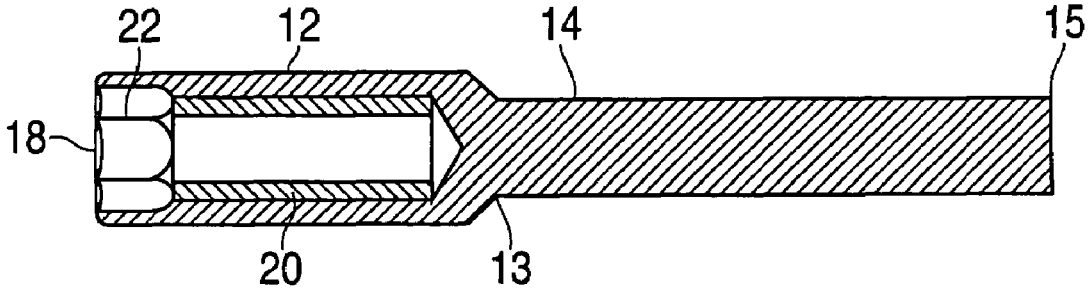
FIG. 4 is a schematic view illustrating a spark plug tool according to an alternative embodiment of the invention.

FIG. 4 is a schematic view illustrating the spark plug tool 10 according to an alternative embodiment of the invention. In this embodiment, the spark plug tool does not have a second housing member 16. The second end 15 of the shaft 14 can be adapted to mate with a torque member. For example, it may have be square shaped to mate with a wrench. In this embodiment, the shaft 14 and the first housing member 12 are integrally connected and create a tool 10 that is long enough to reach the recessed spark plug. In operation, the spark plug installation and removal are similar as previously described except the torque member engages the second end 15 of the shaft 14 instead of the second housing member 16.

Although an example of the spark plug tool 10 is shown using integrally formed connections, it will be appreciated that other connections can be used. Also, although the spark plug tool 10 is useful to install and remove spark plugs to and from engine recesses, it can also be used install and remove other things to and from hard to reach areas.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A spark plug tool, comprising:

a shaft having a first end and a second end, a constant diameter and a length from about 2 inches to about 5 inches;

a first housing member integrally connected to the first end of the shaft and having a first open portion, such that an outer diameter of the shaft is less than an outer diameter of the first housing member, wherein the first open portion comprises an internal polygonal configuration that is adapted to couple with about a 9/16 hex size spark plug; and a second housing member integrally connected to the second end of the shaft and having a second open portion for mating with a torque member, such that the outer diameter of the shaft is less than an outer diameter of the second housing member.

2. The apparatus of claim 1, further comprising an elastomeric sleeve disposed in the first housing member for retaining the spark plug.

3. The apparatus of claim 1, wherein the first open portion comprises an internal polygonal configuration that has a cross sectional distance from about 0.566 inch to about 0.576 inch.

4. The apparatus of claim 1, wherein the spark plug tool has a length from about 3½ inches to about 12 inches.

5. The apparatus of claim 4, wherein the spark plug tool has a length from about 5½ inches to about 10 inches.

6. The apparatus of claim 1, wherein the first housing member has a length from about 1 inch to about 4 inches.

7. The apparatus of claim 6, wherein the first housing member has a length from about 2 inches to about 3 inches.

8. The apparatus of claim 1, wherein the shaft has a length of about 3 inches.

9. The apparatus of claim 1, wherein the second housing member has a length from about ½ inch to about 3 inches.

10. The apparatus of claim 1, wherein the second housing member has an knurled outer surface.

11. The apparatus of claim 1, wherein the torque member is selected from a group consisting of a wrench, pliers, a human hand, a screwdriver and other torquing tools.

12. A method of rotating a spark plug within an engine, comprising:

providing a spark plug tool having a first housing member adapted to mate with the sparkplug and a second housing member having a knurled outer surface and adapted to couple with a torque member;

coupling the first housing member with the spark plug;

coupling the second housing member with the spark plug; and rotating the second housing member with the torque member, wherein the spark plug tool further comprises a shaft having a constant diameter and a length from about 2 inches to about 5 inches that is integrally connected to the first and second housing members, such that an outer diameter of the shaft is less than an outer diameter of the first and second housing members and the first housing member has a first open portion having an internal polygonal configuration that is adapted to mate with about a 9/16 hex size spark plug.

13. The method of claim 12, wherein coupling the first housing member with the spark plug is with an elastomeric sleeve that is disposed in the first housing member for retaining the spark plug.

14. The method of claim 12, wherein rotating the second housing member further comprises rotating in a first direction to install the spark plug.

15. The method of claim 12, wherein rotating the second housing member further comprises rotating in a second direction to remove the spark plug.

16. The method of claim 12, further comprising moving the spark plug tool with the spark plug away from the engine.

17. The method of claim 12, further comprising moving the spark plug tool with the spark plug towards the engine.

18. A device for installing and removing a spark plug, comprising:

a shaft having a first end and a second end, a constant diameter and having a length from about 2 inches to about 5 inches;

means for coupling with a spark plug that is integrally connected to the first end of the shaft, such that an outer diameter of the shaft is less than an outer diameter of the means for coupling, and has a first open portion for mating with a spark plug, wherein the first open portion comprises an internal polygonal configuration that is adapted to mate with about a 9/16 hex size spark plug; and means for engaging that is integrally connected to the second end of the shaft and having a second open portion for mating with a torque means, such that the outer diameter of the shaft is less than an outer diameter of the means for engaging.

19. The device of claim 18, further comprising a gripping means disposed in the means for coupling for retaining the spark plug.

20. The device of claim 18, wherein the first open portion comprises an internal polygonal configuration that has a cross sectional distance from about 0.566 inch to about 0.576 inch.

21. The device of claim 18, wherein the system for installing and removing has a length from about 3½ inches to about 12 inches.

22. The device of claim 21, wherein the system for installing and removing has a length from about 5½ inches to about 10 inches.

23. The device of claim 18, wherein the means for coupling has a length from about 1 inch to about 4 inches.

24. The device of claim 23, wherein the means for coupling has a length from about 2 inches to about 3 inches.

25. The device of claim 18, wherein the shaft has a length of about 3 inches.

26. The device of claim 18, wherein the means for engaging has a length from about ½ inch to about 3 inches.

27. The device of claim 18, wherein the means for engaging has an knurled outer surface.

28. The device of claim 18, wherein the torque means is selected from a group consisting of a wrench, pliers, a human hand, a screwdriver and other torquing tools.

29. A spark plug tool, comprising:

a shaft having a first end and a second end, a constant diameter and a length of about 3 inches;

a first housing member integrally connected to the first end of the shaft and that has a first open portion, such that an outer diameter of the shaft is less than an outer diameter of the first housing member, wherein the first open portion comprises an internal polygonal configuration that is adapted to mate with about a 9/16 hex size spark plug, and wherein the second end of the shaft is adapted to mate with a torque member.

* * * * *